US005310491A

United States Patent [19]

Downs et al.

[11] Patent Number: 5,310,491

[45] Date of Patent: May 10, 1994

[54] LUBRICANT COMPOSITION CONTAINING ANTIOXIDANT

[75] Inventors: Bruce W. Downs, South Glastonbury; Robert G. Rowland, Woodbridge, both of Conn.

[73] Assignee: Uniroyal Chemical Company, Inc., Middlebury, Conn.

[21] Appl. No.: 46,252

[22] Filed: Apr. 13, 1993

[51] Int. Cl.[5] ..... C10M 133/02

[52] U.S. Cl. ..... 252/50; 252/51

[58] Field of Search ..... 252/50, 51

[56] References Cited

U.S. PATENT DOCUMENTS

| | | | |
|---|---|---|---|
| 2,400,500 | 2/1944 | Gibbs | 260/288 |
| 2,813,076 | 11/1957 | Edelman et al. | 252/32.7 |
| 3,296,136 | 1/1967 | Eickemeyer et al. | 252/47.5 |
| 3,697,574 | 10/1972 | Plask et al. | 260/462 R |
| 4,118,329 | 10/1978 | Hotten | 252/32.5 |
| 4,122,021 | 10/1978 | Loveless et al. | 252/26 |
| 4,331,546 | 5/1982 | Frangston | 252/49.9 |
| 4,704,219 | 11/1987 | Shaw | 252/50 |

OTHER PUBLICATIONS

Horning, ed., Organic Syntheses, Collective vol. 3, pp. 329–330 (1955).

*Primary Examiner*—John Niebling
*Assistant Examiner*—Edna Wong
*Attorney, Agent, or Firm*—Jerome D. Drabiak

[57] ABSTRACT

A lubricant composition contains the reaction product of an alkyl-substituted 1,2-dihydroquinoline and a diarylamine as antioxidant.

13 Claims, No Drawings

LUBRICANT COMPOSITION CONTAINING ANTIOXIDANT

BACKGROUND OF THE INVENTION

This invention relates to a lubricant composition containing an antioxidant which inhibits its oxidative breakdown.

Contact between a lubricating oil and metal surfaces inside an engine can result in the deposition of metal-containing particles into the oil. These particles can function as oxidation catalysts which promote the degradation of the oil. Elevated temperatures, common in engines and other operating machinery, are also known to accelerate the oxidation of a lubricating oil.

The oxidation of a lubricating oil adversely affects the physical and chemical properties of the oil and diminishes its ability to protect engine parts. Thus, e.g., oxidation of a lubricating oil can increase the acidity of the oil which expedites the wear and corrosion of engine parts. Oxidation can produce sludge and varnish which clogs oil circulatory channels. Furthermore, oxidation can increase the viscosity of the oil which interferes with oil circulation and filtering systems.

In order to prevent these undesirable effects, an oil-soluble antioxidant composition is often added to the lubricant to inhibit oxidation of the oil, increase the lubricity of the oil and regulate fluctuations in the viscosity of the oil caused by changes in temperature.

The reaction product of a 1,2-dihydroquinoline with a diarylamine in the presence of an acid catalyst is disclosed in U.S. Pat. No. 2,400,500 as an antioxidant for animal and vegetable oils, e.g., fish oil, linseed oil, tung oil, gasolines containing unsaturates, rubber, and the like. This patent does not disclose or suggest the use of such a reaction product as an antioxidant for natural or synthetic lubricating oils having industrial equipment, automotive, aviation, diesel and marine applications.

SUMMARY OF THE INVENTION

A lubricant composition is provided comprising a lubricant base stock to which has been added an oxidation-inhibiting amount of the reaction product of an alkyl-substituted 1,2-dihydroquinoline and a diarylamine.

The resulting reaction product imparts increased protection against oxidative breakdown to a lubricant base stock to which the reaction product has been added.

DESCRIPTION OF THE PREFERRED EMBODIMENTS

Illustrative of the alkyl-substituted 1,2-dihydroquinolines that can be reacted with a diarylamine to provide the antioxidant employed in the lubricant composition of this invention are 2,2,4-trimethyl-1,2-dihydroquinoline, 2-methyl-2,4-diethyl-1,2-dihydroquinoline, 2,2,4,6-tetramethyl-1,2-dihydroquinoline, 2,2,4,7-tetramethyl-1,2-dihydroquinoline, 6,6'-bis(2,2,4-trimethyl-1,2-dihydroquinoline), and the like. A preferred alkyl-substituted 1,2-dihydroquinoline is 2,2,4-trimethyl-1,2-dihydroquinoline (hereinafter referred to as TMDQ), which can be prepared in the laboratory according to the method of Vaughan (W. R. Vaughan, "Organic Synthesis", Collective Volume III, pp. 329–30, (1955)).

Most commercial processes for the manufacture of TMDQ yield product mixtures which contain from about 30 to about 50 percent TMDQ monomer. In one process that has been commercially employed for the production of TMDQ monomer, a mixture of TMDQ monomer and oligomers is obtained by the acid-catalyzed condensation of aniline and acetone, which is then further reacted to create a polymer product. Some of the monomers, however, do not react. Unreacted monomers are removed by steam stripping during the finishing process. The material obtained from the steam strip contains from about 40 to about 80 percent TMDQ monomer, depending on when the monomer is collected during the stripping process, as well as water, solvents and any other volatile materials. The recycle stream is normally returned to the reactor for incorporation into the next batch after being diverted and purified for reuse. The purified material is replaced in the TMDQ process by fresh aniline.

Utilizing this purification process, pure TMDQ monomer can be obtained in amounts ranging in purity from about 78 to about 83 percent by stripping off volatile matter and saving the still bottoms. Simple distillation of this product can provide TMDQ monomer in amounts ranging in purity from about 83 to about 92 percent. Careful fractional distillation of the product obtained by simple distillation can provide TMDQ monomer in amounts greater than about 92 percent purity.

Suitable diarylamines that can be reacted with an alkyl-substituted 1,2-dihydroquinoline to provide the antioxidant employed in the lubricant composition of this invention include diphenylamine, phenyl-alpha-naphthylamine, the ditolylamines, the phenylarolylamines, the dinaphthylamines, 4-phenyl-diphenylamine, p-hydroxydiphenylamine, p-amino-diphenylamine, p-isopropoxydiphenylamine, and the like. A preferred diarylamine is diphenylamine.

The secondary amine reaction products of a diarylamine with an alcohol, aldehyde or ketone are chemically equivalent to the diarylamines and can be employed herein. Accordingly, the term "diarylamine" shall be understood to be inclusive of such reaction products. Of the diarylamine reaction products that can be used herein, those containing only carbon, hydrogen and nitrogen are preferred.

As is known, the reaction of the alkyl-substituted 1,2-dihydroquinoline and diarylamine is generally carried out in the presence of an acidic condensation catalyst. Typical of such a catalyst is a Friedel-Crafts catalyst familiar to those skilled in the art. Examples of such catalysts are hydrogen chloride, phosphoric acid, sulfuric acid, zinc chloride, aluminum chloride, aluminum bromide, ferric chloride, boron trifluoride, hydrofluoric acid, stannic chloride, acid leached clays, iodine, and the like.

In a typical reaction process, a diarylamine such as diphenylamine is melted together with an acid catalyst such as aluminum chloride and an alkyl-substituted 1,2-dihydroquinoline such as TMDQ is thereafter added to the melt. The relative proportions of the reactants can vary considerably. Preferably the mole ratio of alkyl-substituted 1,2-dihydroquinoline to diarylamine is from about 3:2 to about 1:2.5 and more preferably from about 5:4 to about 1:2. The mole ratio of the diarylamine to the acid catalyst can range from about 94:6 to about 65:35, and preferably from about 91:9 to about 82:18. The alkyl-substituted 1,2-dihydroquinoline can be added to the melt over a period of time ranging from about 30 to about 180 minutes and preferably from about 45 to about 120 minutes. The temperature at which the reaction takes place can range from about 80° to about 140° C. and preferably from about 105° to about 125° C. This temperature can be maintained for from about 0 to about 24, and preferably from about 3 to about 4 hours following addition of the reaction ingredients. Following this period of reaction, the reaction mixture is quenched and washed with water, neutralized with dilute aqueous base, e.g., ammonium hydroxide, sodium hydroxide, potassium hydroxide, etc., and finally washed again with water. Unreacted volatiles including excess diphenylamine are removed by distillation under vacuum.

The composition of the resulting reaction product will vary depending upon the reactants, reaction conditions and stoichiometry employed. Thus, e.g., the reaction can include various products of diarylamine alkylation by the alkyl-substituted 1,2-dihydroquinoline unit. The diarylamine can be alkylated with any of various combinations of alkyl-substituted 1,2-dihydroquinolines, including monomer, dimer, trimer, tetramer and higher oligomers.

Addition of the reaction product to a lubricant base provides a lubricant composition possessing superior antioxidant properties. A wide variety of natural and synthetic lubricant bases such as hydrocarbon-based oils, synthetic oils and oils derived from coal can be employed in the practice of the present invention. These lubricant bases include crankcase lubricating oils for spark-ignited and compression-ignited internal combustion engines, including automobile and truck engines, two-cycle engines, aviation piston engines, marine and railroad diesel engines, and the like. The lubricant bases can also be used in gas engines, stationary power engines and turbines, and the like. Automatic transmission fluids, transaxle lubricants, gear lubricants, metal-working lubricants, hydraulic fluids and other lubricating oil and grease compositions can also benefit from the incorporation therein of the antioxidant compositions of the present invention.

Natural oils include solvent-refined or acid-refined mineral lubricating oils of the paraffinic, naphthenic, aromatic or mixed paraffin-naphthenic types. Oils of lubricating viscosity derived from coal or shale are also useful base oils. Synthetic lubricating oils include hydrocarbon oils and halo-substituted hydrocarbon oils such as polymerized and interpolymerized olefins (e.g., polybutylenes, polypropylenes, propyleneisobutylene copolymers, chlorinated polybutylenes, etc.), alkyl benzenes (e.g., dodecylbenzenes, tetradecylbenzenes, dinonylbenzenes, di-(2-ethylhexyl) benzenes, etc.), polyphenols (e.g., biphenyls, terphenyls, etc.), and the like. Alkylene oxide polymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters or mixed $C_3$–$C_8$ fatty acid esters. Another suitable class of synthetic lubricating oils comprises the esters of dicarboxylic acids (e.g., phthalic acid, succinic acid, maleic acid, azelaic acid, suberic acid, sebacic acid, fumaric acid, adipic acid, linoleic acid dimer, etc.) with a variety of alcohols (e.g., butyl alcohol, hexyl alcohol, dodecyl alcohol, 2-ethylhexyl alcohol, pentaerythritol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like. Silicon-based oils such as the polyalkyl-, polyaryl-, polyalkoxy-, or polyaryloxysiloxane oils and silicate oils comprise another useful class of synthetic lubricants (e.g., tetraethyl-silicate, tetraisopropyl-silicate, tetra-(2-ethylhexyl)-silicate, tetra-(4-methyl-2-tetraethyl)-silicate, tetra-(p-tert-butylphenyl)-silicate, hexyl-(4-methyl-2-pentoxy)-disiloxane, poly(methyl)-siloxanes, poly(-methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans, and the like.

Lubricant base stocks can be used individually or in combination when miscible. Lubricant base stocks generally possessing a viscosity range of from about 50 to about 5,000, and preferably from about 100 to about 1500, SUS (Sayboldt Universal Seconds) at 100° F./38° C. can be employed herein.

A lubricant composition in accordance with this invention can be prepared by adding from about 0.01 to about 5, and preferably from about 0.05 to about 1, weight percent of the reaction product to a lubricant base stock. The amount of reaction product utilized will vary with the type of lubricant base being employed, the performance level of the reaction product and the presence of other additives in the lubricant base.

In addition to the antioxidant composition herein, other additives can be added to the lubricant base stock to improve its performance without adversely affecting its stability. Such additives include corrosion and rust inhibitors, anti-foam agents, viscosity index improvers, friction modifiers, pour point improvers, anti-wear and extreme-pressure agents, metal deactivators, dispersants, detergents, and the like.

In many instances, it can be advantageous to form concentrates of the reaction product to provide a convenient method of handling and transporting the antioxidant for subsequent dilution and use. The concentration of the reaction product in the concentrate may vary from about 10 to about 90, and preferably from about 20 to about 50, weight percent based on the entire composition.

The examples which follow illustrate the preparation of lubricant compositions in accordance with this invention and compare the oxidative stability of such compositions with lubricant compositions containing other known antioxidant additives.

EXAMPLE 1

A one-liter reaction kettle equipped with a bottom outlet, overhead stirrer, thermocouple and an addition funnel was charged with diphenylamine (275 g). The vessel was purged with nitrogen, then charged with aluminum chloride as catalyst (27.5 g). The mixture was heated to melt the diphenylamine and then further heated to 115° C. 2,2,4-trimethyl 1,2-dihydroquinoline (260 g; 95% pure as analyzed by gas chromatography) was added to the melt over a 90 minute period. The reaction mass was heat treated for an additional 4 hours and the reactor temperature was brought to 90° C.

Hot water was added slowly, followed by a modest amount of xylene. The aqueous layer was removed by separation and the reaction mass was neutralized with dilute ammonium hydroxide and washed with hot water.

The product was purified and dried by distillation at atmospheric pressure. Volatile organics, including excess diphenylamine, were then removed by distillation under vacuum. The product was filtered while hot, yielding 305 grams of a dark amber, glassy product. Hereinafter, this reaction product will be referred to as Antioxidant Composition A.

EXAMPLES 2-4

A 2-liter reaction kettle equipped with a bottom outlet, overhead stirrer, thermocouple and an addition funnel was charged with diphenylamine (486 g). The vessel was purged with nitrogen and then charged with aluminum chloride as catalyst (48.6 g). The mixture was heated to melt the diphenylamine and then heated further to 115° C. 2,2,4-trimethyl 1,2-dihydroquinoline (565 g; 78% pure as analyzed by gas chromatography) was added to the melt over a 110 minute period. The reaction mass was heat treated for an additional 4 hours and the reactor temperature was brought to 90° C.

Hot water was added slowly, followed by a modest amount of xylene. The aqueous layer was removed by separation, and the reaction mass was neutralized with dilute ammonium hydroxide, followed by two hot water washings.

The product was purified and dried by distillation at atmospheric pressure. Volatile organics, including excess diphenylamine, were then removed by distillation under vacuum. The product was filtered while hot, yielding 582 grams of reaction product. Hereinafter, this product will be referred to as Antioxidant Composition B.

Antioxidant Compositions C and D were produced by the same method described in Examples 1 and 2, the only difference being that 84% and 91% pure TMDQ monomer was employed in producing each antioxidant composition, respectively.

EXAMPLES 5-29 AND COMPARATIVE EXAMPLES 1 AND 2

Antioxidant compositions A, B, C and D were individually added to an SG Grade 10W30 motor oil containing a standard package of additives except a supplemental antioxidant. In addition, two commercially available antioxidant compositions, referred to herein as Antioxidant Compositions E and F, namely, Irganox L57 (Ciba Geigy Corp.) and Vanlube SL (R. T. Vanderbilt Corp.) respectively, were added to the same SG Grade 10W30 motor oil. Irganox L57 is a mixture of butylated and octylated diphenylamines and Vanlube SL is a mixture of octylated and styrenated diphenylamines.

The motor oils to which the various antioxidants had been added were evaluated for oxidative stability employing ASTM 4742-88, i.e., the Standard Method for Thin-Film Oxygen Uptake Test (TFOUT). The TFOUT involves heating a sample of oil along with small amounts of liquid metal catalysts and partially oxidized fuel to 160° C. in a bomb pressurized with oxygen. The induction time is measured from the beginning of the test to the point where a definite pressure loss begins, i.e., to the point where oxidation of the motor oil begins. Thus, increases in induction time are indicative of greater oxidative stability. The TFOUT was also performed on three samples of the SG Grade IOW30 motor oil containing no antioxidant (referred to herein as the Controls).

The results of the TFOUT are set forth in the following table:

TABLE 1

OXIDATIVE STABILITY OF LUBRICANT COMPOSITIONS MEASURED BY THE TFOUT

| EXAMPLE | ANTI-OXIDANT COMPO-SITION | CONCENTRATION (WT. %) ANTIOXIDANT COMPOSITION IN LUBRICANT BASE | INDUC-TION TIME (MIN-UTES) |
|---|---|---|---|
| Control 1 | — | — | 166 |
| Control 2 | — | — | 147 |
| Control 3 | — | — | 154 |
| Comparative Example 1 | E | 0.5 | 258 |
| Comparative Example 2 | F | 0.5 | 223 |
| 5 | A | 0.1 | 191 |
| 6 | A | 0.2 | 215 |
| 7 | A | 0.3 | 269 |
| 8 | A | 0.4 | 304 |
| 9 | A | 0.5 | 358 |
| 10 | B | 0.1 | 172 |
| 11 | B | 0.2 | 212 |
| 12 | B | 0.3 | 234 |
| 13 | B | 0.4 | 264 |
| 14 | B | 0.5 | 318 |
| 15 | B | 0.1 | 166 |
| 16 | B | 0.2 | 195 |
| 17 | B | 0.3 | 229 |
| 18 | B | 0.4 | 277 |
| 19 | B | 0.5 | 323 |
| 20 | C | 0.1 | 173 |
| 21 | C | 0.2 | 206 |
| 22 | C | 0.3 | 251 |
| 23 | C | 0.4 | 291 |
| 24 | C | 0.5 | 323 |
| 25 | D | 0.1 | 180 |
| 26 | D | 0.2 | 222 |
| 27 | D | 0.3 | 262 |
| 28 | D | 0.4 | 312 |
| 29 | D | 0.5 | 347 |

As the foregoing data clearly demonstrate, the addition of the antioxidant compositions of this invention, e.g., Antioxidant Compositions A-D, to a motor oil containing a standard package of additives (except supplemental antioxidant) significantly increases the induction time of the lubricant composition relative to the control samples to which no antioxidant had been added. The test data also show that the antioxidant compositions of this invention offer superior protection against oxidative breakdown relative to the commercially available Antioxidant Compositions E and F. Furthermore, it can be seen from the data that smaller quantities of the antioxidant composition of this invention can be employed to achieve a level of antioxidant protection equivalent to that achieved by greater quantities of the commercially available antioxidant compositions.

EXAMPLE 30 AND COMPARATIVE EXAMPLES 3-8

The oxidative stabilities of industrial turbine and hydraulic lubricants containing various antioxidants were evaluated using ASTM 02272, i.e., the Rotary Bomb Oxidation Test (RBOT).

The test was performed as follows:

50 g of each of the lubricant compositions (containing 0.5 weight percent of antioxidant except the lubricant composition of Comparative Example 3, which, as a control, contained no antioxidant), 5 g water and 3 meters of copper wire were placed in a glass beaker which was located in a steel bomb. The base oil employed in formulating the lubricant compositions was a high performance mineral oil-based turbine oil containing all necessary additives except an amine-based antioxidant. The bomb was pressure-sealed to 90 psi with oxygen and placed in a bath at 150° C. The pressure on the system increased as temperature increased. When oxidation of the lubricant composition began, the pressure of the system decreased as oxygen was consumed. When the oxygen was completely consumed, the pressure on the closed system decreased. The endpoint was measured when the pressure dropped 25 psi below the highest plateau attained. Data from the RBO test is widely accepted in the lubricant industry as a measure of oxidative stability.

The lubricants and the antioxidant compositions present therein are as follows:

| LUBRICANT COMPOSITION | Antioxidant Component |
|---|---|
| Example 30 | Antioxidant Composition A (Example 1) |
| Comparative Example | |
| 3 | No Antioxidant Present |
| 4 | Antioxidant Unknown |
| 5 | Irganox L57 (butylated/octylated diphenylamine mixture) |
| 6 | Irganox L06 (octylated phenyl α-naphthylamine) |
| 7 | Vanlube DND (dinonyldiphenylamine) |
| 8 | Vanlube NA (nonylated diethyl diphenylamine) |

The results of the RBOT are set forth in the following table:

TABLE 2

| OXIDATIVE STABILITY OF LUBRICANT COMPOSITIONS MEASURED BY THE RBOT | INDUCTION TIME (MIN.) |
|---|---|
| EXAMPLE 30 | 3725 |
| COMPARATIVE EXAMPLE | |
| 3 | 22 |
| 4 | 1593 |
| 5 | 740 |
| 6 | 2046 |
| 7 | 417 |
| 8 | 145 |

The results presented in Table 2 above clearly demonstrate that the antioxidant composition of this invention imparts superior antioxidant protection to a lubricant (Example 30) relative to commercially available antioxidants (Comparative Examples 4-8). In addition, a smaller quantity of the antioxidant of this invention can be employed to achieve the same effect as greater quantities of the commercially available antioxidants.

EXAMPLES 31-34 AND COMPARATIVE EXAMPLES 9-16

The reaction product of this invention can be utilized as an antioxidant additive in heavy duty diesel oils. One widely accepted test for evaluating antioxidants in diesel oils is the Caterpillar Micro-Oxidation Test (CMOT; SAE 890239). The CMOT involves heating a sample of formulated heavy duty diesel oil containing 0.5 weight percent antioxidant at 230° C. At specified time intervals, the weight percent of the deposits are determined. These data are plotted versus time to identify the induction time. The induction time relates to the point at which deposit formation in the oil increases sharply.

The following lubricant compositions were evaluated using the CMOT:

| LUBRICANT COMPOSITION | Base Oil | Antioxidant Component |
|---|---|---|
| Example | | |
| 31 | I | Antioxidant Composition A (Example 1) |
| 32 | I | Antioxidant Composition A (Example 1) |
| 33 | I | Antioxidant Composition A (Example 1) |
| 34 | II | Antioxidant Composition A (Example 1) |
| Comparative Example | | |
| 9 | I | Naugard 445 (4,4'di(α,α-dimethyl benzyl) diphenylamine) |
| 10 | I | Naugalube 640 (mixture of butylated and octylated diphenylamines |
| 11 | I | Naugard 445 |
| 12 | I | Naugalube 640 |
| 13 | I | Naugard 445 |
| 14 | I | Naugalube 640 |
| 15 | II | Naugard 445 |
| 16 | II | Irganox L57 (mixture of butylated and octylated diphenylamines) |

Base Oil I is a mineral oil-based heavy duty diesel engine oil containing all necessary additives except supplemental antioxidant. Base Oil II is a mineral oil-based marine diesel engine oil containing all necessary additives except supplemental antioxidant The data resulting from the CMOT were as follows:

TABLE 3

| PERFORMANCE OF ANTIOXIDANT COMPOSITIONS | |
|---|---|
| EXAMPLE | INDUCTION TIME (MINUTES) |
| Example 31 | 145 |
| Comparative Example 9 | 158 |
| Comparative Example 10 | 129 |
| Example 32 | 155 |
| Comparative Example 11 | 135 |
| Comparative Example 12 | 109 |
| Example 33 | 173 |
| Comparative Example 13 | 156 |
| Comparative Example 14 | 134 |
| Example 34 | 150 |
| Comparative Example 15 | 138 |
| Comparative Example 16 | 105 |

As the above data indicate, the antioxidant compositions of the present invention yielded higher induction times than the antioxidant compositions of Comparative Examples 9–16 in all but one case, Example 31. As these data show, the antioxidant compositions herein are superior to those which are in current commercial use.

The data in Tables 1, 2, and 3 clearly demonstrate that the lubricant compositions of this invention possess superior resistance to oxidative breakdown relative to lubricant compositions to which no antioxidant has been added and also relative to commercially available lubricant compositions containing antioxidants other than the reaction product of this invention.

What is claimed is:

1. A lubricant composition comprising a lubricant base stock to which has been added an oxidation-inhibiting amount of the reaction product of an alkyl-substituted 1,2-dihydroquinoline with a diarylamine wherein the lubricant base stock is selected from the group consisting of a hydrocarbon-based oil, a mineral oil, a synthetic oil, an oil derived from coal or shale, a silicone-based oil, a crankcase lubrication oil for spark-ignited internal combustion engines, a crankcase lubricating oil for compression-ignited internal combustion engines, a transmission fluid, a transaxle lubricant, a gear lubricant, a metal-working lubricant, a hydraulic fluid, a grease, and miscible mixtures thereof.

2. The lubricant composition of claim 1 wherein the reaction product is present in the lubricant base stock in an amount ranging from about 0.01 to about 5 weight percent based on the entire lubricant composition.

3. The lubricant composition of claim 1 wherein the reaction product is present in the lubricant base stock in an amount ranging from about 0.05 to about 1 weight percent based on the entire lubricant composition.

4. The lubricant composition of claim 1 wherein the alkyl-substituted 1,2-dihydroquinoline is selected from the group consisting of 2,2,4-trimethyl-1,2-dihydroquinoline, 2-methyl-2,4-diethyl-1,2-dihydroquinoline, 2,2,4,6-tetramethyl-1,2-dihydroquinoline, 2,2,4,7-tetramethyl-1,2-dihydroquinoline and 6,6'-bis(2,2,4-trimethyl-1,2-dihydroquinoline).

5. The lubricant composition of claim 1 wherein the diarylamine is selected from the group consisting of diphenylamine, naphthylamine, phenyl-alpha-naphthylamine, the ditolylamines, the phenylatolylamines, the dinaphthylamines, 4-phenyl-diphenylamine, dianilinodiphenylmethane, p-hydroxydiphenylamine, p-aminodiphenylamine, N,N'-diphenyl-p-phenylenediamine, anilinobiphenylene oxide, and p-isopropoxydiphenylamine.

6. The lubricant composition of claim 1 wherein the alkyl-substituted 1,2-dihydroquinoline is selected from the group consisting of 2,2,4-trimethyl-1,2-dihydroquinoline, 2-methyl-2,4-diethyl-1,2-dihydroquinoline, 2,2,4,6-tetramethyl-1,2-dihydroquinoline, 2,2,4,7-tetramethyl-1,2-dihydroquinoline and 6,6'-bis(2,2,4-trimethyl-1,2-dihydroquinoline) and the diarylamine is selected from the group consisting of diphenylamine, naphthylamine, phenyl-alpha-naphthylamine, the ditolylamines, the phenylatolylamines, the dinaphthylamines, 4-phenyl-diphenylamine, dianilinodiphenylmethane, p-hydroxydiphenylamine, p-aminodiphenylamine, N,N'-diphenyl-p-phenylenediamine, anilinobiphenylene oxide and p-isopropoxydiphenylamine.

7. The lubricant composition of claim 1 wherein the mole ratio of alkyl-substituted 1,2-dihydroquinoline to diarylamine is from about 3:2 to about 1:2.5.

8. The lubricant composition of claim 1 wherein the mole ratio of alkyl-substituted 1,2-dihydroquinoline to diarylamine is from about 5:4 to about 1:2.

9. The lubricant composition of claim 1 wherein the alkyl-substituted 1,2-dihydroquinoline is 2,2,4-trimethyl-1,2-dihydroquinoline and the diarylamine is diphenylamine.

10. The lubricant composition of claim 9 wherein the 2,2,4-trimethyl-1,2-dihydroquinoline is from about 60 to about 100 percent pure.

11. The lubricant composition of claim 9 wherein the 2,2,4-trimethyl-1,2-dihydroquinoline is from about 70 to about 90 percent pure.

12. The lubricant composition of claim 9 wherein the mole ratio of 2,2,4-trimethyl-1,2-dihydroquinoline to diphenylamine is from about 3:2 to about 1:2.5.

13. The lubricant composition of claim 9 wherein the mole ratio of 2,2,4-trimethyl-1,2-dihydroquinoline to diphenylamine is from about 5:4 to about 1:2.

* * * * *